US006269781B1

(12) United States Patent
Suzuki et al.

(10) Patent No.: US 6,269,781 B1
(45) Date of Patent: Aug. 7, 2001

(54) HEAT GENERATOR

(75) Inventors: Shigeru Suzuki; Masami Niwa; Tatsuyuki Hoshino, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/615,460

(22) Filed: Jul. 13, 2000

(30) Foreign Application Priority Data

Aug. 6, 1999 (JP) ..... 11-223968

(51) Int. Cl.[7] ..... F22B 3/06
(52) U.S. Cl. ..... 122/26; 126/247
(58) Field of Search ..... 122/26; 126/247; 237/12.3 R, 12.3 B

(56) References Cited

U.S. PATENT DOCUMENTS 4,993,377 2/1991 Itakura ..... 123/142.1
5,573,184 * 11/1996 Martin ..... 237/12.3 R

FOREIGN PATENT DOCUMENTS

A-9-323534 12/1997 (JP) .
A-10-217757 8/1998 (JP) .

* cited by examiner

*Primary Examiner*—Jiping Lu
(74) *Attorney, Agent, or Firm*—Woodcock Washburn Kurt Mackiewicz & Norris LL

(57) ABSTRACT

In a heat generator of the invention in which a drive shaft 8 is made of an iron-type metal, a rotor 9 includes a main rotor body 9*a* made of an aluminum-type metal for shearing a silicone oil SO and a bush 9*b* made of an iron-type metal inserted in the main rotor body 9*a* and secured to the drive shaft 8 while being positioned in contact with the inner race 7*a* of a bearing device 7. The main rotor body 9*a* has at least a gap Δ relative to the inner race 7*a* of the bearing device 7, and is permitted to undergo thermal expansion.

5 Claims, 4 Drawing Sheets

HEAT GENERATOR

BACKGROUND OF THE INVENTION

1. Field of the Invention

The present invention relates to a heat generator which heats a viscous fluid by shearing, and exchanges the heat with a fluid circulating in a heat-receiving chamber in order to utilize the heat.

2. Description of the Related Art

Japanese Unexamined Patent Publication (Kokai) No. 10-217757 discloses a heat generator used as a heating device for vehicles. In this heat generator, a housing includes a heat-generating chamber and a water jacket which is a heat-receiving chamber neighboring the heat-generating chamber and permitting the cooling water which is a circulating fluid to circulate. The housing rotatably supports a drive shaft via a bearing that incorporates a shaft-sealing means, a pulley is attached to a front end of the drive shaft such that the drive shaft is driven by an engine through a belt, and a disk-like rotor is secured to a rear end of the drive shaft, by being pressed on, so as to rotate in the heat-generating chamber. Fluid-tight gaps between the wall surfaces of the heat-generating chamber and the outer surfaces of the rotor are filled with a viscous fluid such as silicone oil or the like that generates heat when the rotor is rotated.

In this heat generator incorporated in the heating device of a vehicle, the rotor rotates in the heat-generating chamber when the drive shaft is driven by the engine, and the viscous fluid generates heat due to the shearing in the fluid-tight gaps between the wall surfaces of the heat-generating chamber and the outer surfaces of the rotor. The heat is exchanged by the cooling water in the water jacket, and the cooling water that is heated is used for heating the compartment through a heating circuit.

In the above heat generator, however, the drive shaft is made of an iron-type metal having a high rigidity whereas the rotor secured to the drive shaft as a whole is made of an aluminum-type metal after taking the machinability and reduced weight into consideration. In this heat generator, therefore, when the rotor is rotated by the drive shaft so that the viscous fluid generates heat due to the shearing in the heat-generating chamber, the torque of the drive shaft is not reliably transmitted to the rotor, and slipping occurs between the drive shaft and the rotor due to a difference in the coefficient of thermal expansion between the drive shaft and the rotor, making it difficult to rotate the two together.

To cope with this point, it can be contrived to constitute a rotor by a disk-like main rotor body and a base portion fastened by rivet to the main rotor body and coupled to the drive shaft by spline as is done in the heat generator disclosed in Japanese Unexamined Patent Publication (Kokai) No. 9-323534.

In this heat generator, however, members such as rivets are necessary for securing the base portion to the main rotor body, and the increased number of parts drive up the cost of production. In this heat generator, further, since the base portion is coupled to the drive shaft by spline, the spline must be cut in the drive shaft and in the base portion, resulting in an increase in the number of the steps and again driving up the cost of production.

There can be further contrived a heat generator having a rotor which includes a main rotor body for shearing the viscous fluid made of a material having a coefficient of thermal expansion larger than that of the drive shaft, and a base portion made of a material having a coefficient of thermal expansion equal to that of the drive shaft, inserted into the main rotor body and secured to the drive shaft. This heat generator can be cheaply produced, and the drive shaft and the rotor can be reliably rotated together during the operation.

In this heat generator, however, it is obvious that a conflict exists between the ease of fabrication and the durability. That is, in this heat generator as shown in FIG. 8, a rotor 90 can be easily assembled if a base portion 90*a* secured to a drive shaft 92 is positioned by being contacted with a bearing device 91 which is a positioning member or, more concretely, if the base portion 90*a* secured to the drive shaft 92 is positioned by being contacted with an inner race 91*a* of the bearing device 91. In this heat generator, however, if the base portion 90*a* and the main rotor body 90*b* are formed having the same end surfaces without paying attention to the relationship between the main rotor body 90*b* of the rotor and the bearing device 91 or, more concretely, between the main rotor body 90*b* of the rotor and the inner race 91*a* of the bearing device 91, the main rotor body 90*b* thermally expands more than the base portion 90*a* and pushes the bearing device 91 or, more concretely, pushes the inner race 91*a* of the bearing device 91 in the axial direction when the viscous fluid generates heat during the operation and the internal temperature is elevated, since the main rotor body 90*b* is made of a material having a coefficient of thermal expansion larger than that of the base portion 90*a*. Due to the reaction, therefore, the main rotor body 90*b* may be deviated in the axial direction relative to the base portion 90*a*, and a deformation may take place along the boundary thereof.

SUMMARY OF THE INVENTION

The present invention was accomplished in view of the above-mentioned circumstances, and provides a heat generator which can be cheaply manufactured, enables the drive shaft and the rotor to be reliably rotated together during the operation, and provides both easy assembly and durability.

The heat generator according to the present invention comprises:

a housing forming therein a heat-generating chamber and a heat-receiving chamber neighboring said heat-generating chamber and circulating a fluid;

a drive shaft rotatably supported by said housing via bearing devices;

a rotor rotatably provided in said heat-generating chamber by said drive shaft; and a viscous fluid filled in the gaps between the wall surfaces of the heat-generating chamber and the outer surfaces of the rotor and generates heat due to shearing when said rotor is rotated; wherein said rotor includes a main rotor body for shearing said viscous fluid made of a material having a coefficient of thermal expansion larger than that of said drive shaft, and a base portion made of a material having a coefficient of thermal expansion equivalent to that of said drive shaft, inserted into said main rotor body and secured to said drive shaft while being positioned upon coming in contact with a positioning member, at least said main rotor body being permitted to undergo a thermal expansion with respect to said positioning member.

The present invention may be more fully understood from the description of preferred embodiments of the invention set forth below, together with the accompanying drawings.

DESCRIPTION OF THE PREFERRED EMBODIMENTS

Embodiments 1 to 3 of the invention will now be described with reference to the drawings.

Embodiment 1.

Figure 1:
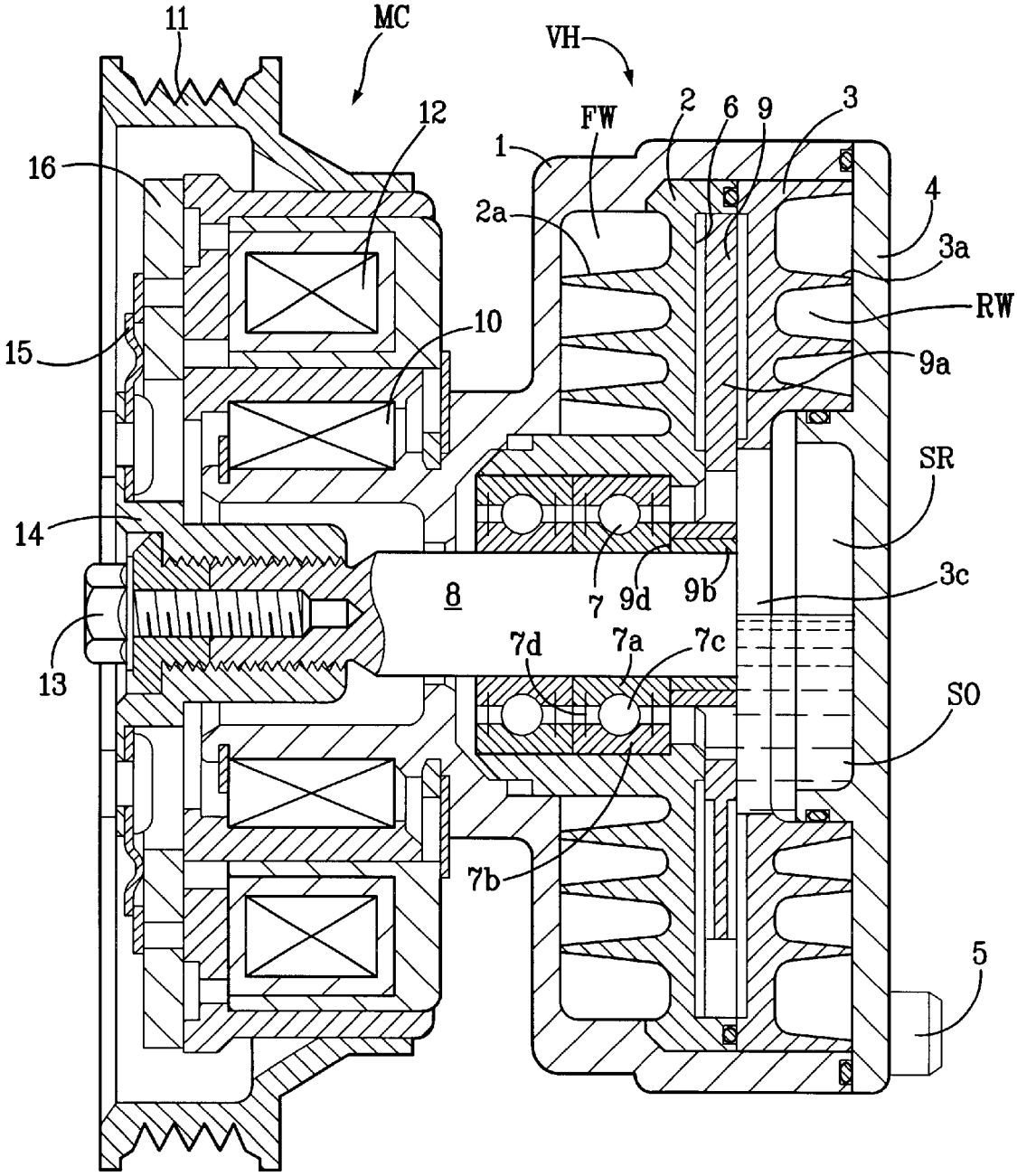
FIG. 1 is a vertical sectional view of a viscous heater according to an embodiment 1 of the present invention.

In a viscous heater VH which is the heat generator according to an embodiment 1 as shown in FIG. 1, a front housing body 1, a front plate 2, a rear plate 3 of nearly the shape of a ring and a rear housing body 4 are joined together via O-rings, and are fastened together using plural bolts 5. A recessed portion of a circular shape is formed in the back surface of the front plate 2, and defines a heat-generating chamber 6 together with the front surface of the rear plate 3. Further, a reservoir chamber SR is formed by the rear plate 3 and the rear housing body 4. An operation chamber is constituted by the heat-generating chamber 6 and the reservoir chamber SR.

Arcuate fins 2*a* are formed in a plural number on the front surface of the front plate 2 and protrude forward in the axial direction. The front housing body 1 and the fins 2*a* are forming a front water jacket FW which is a front heat-receiving chamber. Further, arcuate fins 3*a* are formed in a plural number on the back surface of the rear plate 3 protruding backward in the axial direction. The rear housing body 4 and the fins 3*a* form a rear water jacket RW which is a rear heat-receiving chamber. The cooling water which is a fluid to circulate in the front and rear water jackets FW and RW, flows along the fins 2*a* and 3*a*. The fins 2*a* and 3*a* are for increasing the heat-receiving areas.

In the shaft hole of the front plate 2 are provided plural rows of bearing devices 7 each having an inner race 7*a*, an outer race 7*b*, and balls 7*c* held by a holding unit 7*d* between the inner race 7*a* and the outer race 7*b*. The inner race 7*a* is made of an iron-type metal (carbon steel for bearings) and has a coefficient of thermal expansion β of about $10.7\times10^{-6}$ (° C.). A sealing member that is not shown is provided on the rear side between the inner race 7*a* and the outer race 7*b* in the bearing device 7 of the rear side.

A drive shaft 8 is rotatably supported by the bearing device 7. The drive shaft 8 is made of an iron-type metal (structural carbon steel) and has a coefficient of thermal expansion β of about $10.7\times10^{-6}$ (° C.).

Figure 2A:
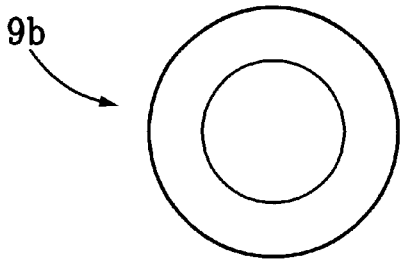
FIG. 2A is a plan view of a bush of the viscous heater of the embodiment 1.
Figure 2B:
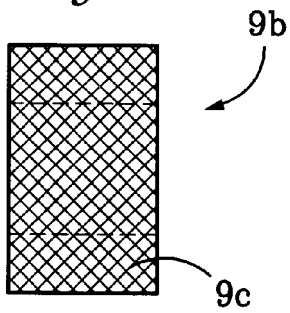
FIG. 2B is a side view of the bush.

A rotor 9 is secured to the rear end of the drive shaft 8 to rotate in the heat-generating chamber 6. The rotor 9 is constituted by a disk-like main rotor body 9*a*, and a bush 9*b* serving as a base portion inserted along the outer peripheral surface of the base portion into the main rotor body 9*a* and forms the inner side of a boss portion extending in the axial direction of the main rotor body 9*a*. The main rotor body 9*a* is made of an aluminum-type metal (die cast alloy) and has a coefficient of thermal expansion p of about $21.0\times10^{-6}$ (° C.). The bush 9*b* is made of an iron-type metal (structural carbon steel) and has a coefficient of thermal expansion β of about $10.7\times10^{-6}$ (° C.). As shown in FIGS. 2A and 2B, the outer peripheral surface of the bush 9*b* is double-cut knurled having rough notches 9*c* meeting at inclined angles with respect to the axial direction.

Figure 3:
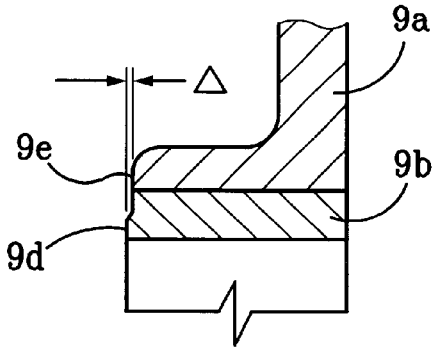
FIG. 3 is a sectional view illustrating a major portion of the viscous heater of the embodiment 1.

To obtain the above rotor 9, the bush 9*b* which is double-cut knurled is prepared through a favorable work and is mounted in a mold. Then, a melt of an aluminum-type metal (die cast alloy) is poured into the cavity, cooled, and the mold is opened to take out a cast article. Then, the cast article is subjected to the machining such as forming holes and grooves, as well as polishing. In this case as shown in FIG. 3, a reference surface 9*d* is formed on the front surface of the bush 9*b*, and a surface 9*e* having a step Δ of several microns with respect to the reference surface 9*d* is formed on the front surface of the bush 9*b* on the side of the main rotor body 9*a* and on the main rotor body 9*a*. Thus, there is obtained the rotor 9 having the main rotor body 9*a* formed by the solidification of a melt of the aluminum-type metal (die cast alloy) and the bush 9*b* inserted into the main rotor body 9*a*. Referring to FIG. 1, communication holes 9*d* are penetrating back and forth in a plural number through the main rotor body 9*a* at positions close to the bush 9*b*.

Figure 4:
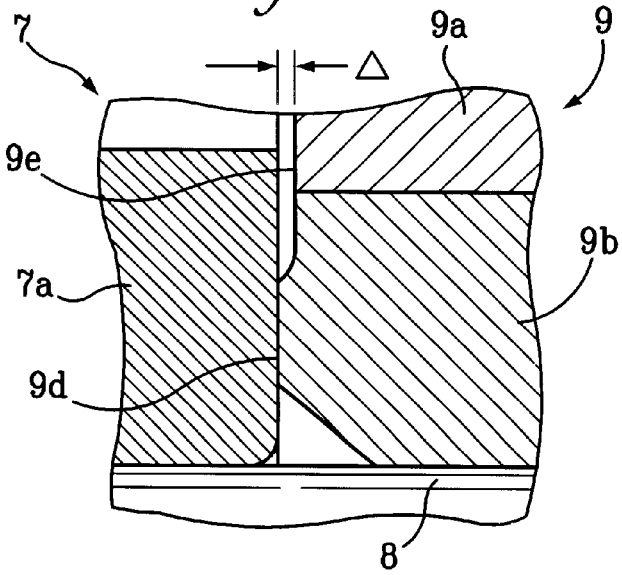
FIG. 4 is a sectional view illustrating, on an enlarged scale, the major portion of the viscous heater of the embodiment 1.

The rotor 9 is secured by pressing the bush 9*b* onto the drive shaft 8 while maintaining a predetermined interference (shrink range). Thus, as shown in FIG. 1, the main rotor body 9*a* of the rotor 9 maintains fluid-tight gaps in the heat-generating chamber 6 relative to the front and rear plates 2 and 3. Referring to FIG. 4, further, due to the step Δ, a portion of the front surface of the bush 9*b* on the side of the main rotor body 9*a* and the surface 9*e* of the main rotor body 9*a* maintain a gap Δ relative to the inner race 7*a* of the bearing device 7.

The reservoir chamber SR is capable of holding the silicone oil SO in an amount in excess of the volume in the fluid-tight gaps. The fluid-tight gaps among the front and rear plates 2, 3 and the rotor 9, and the reservoir chamber SR are filled with the silicone oil SO which is a viscous fluid at a filling ratio of 40 to 70% by volume, and the remaining proportion is occupied by the air. The rear plate 3 is constituting a separator wall relative to the reservoir chamber SR, and a port 3*c* is perforated in a central region of the rear plate 3 across the liquid level of the silicone oil SO in the reservoir chamber SR. The viscous heater VH is constituted as described above.

The front housing body 1 and the drive shaft 8 are provided with an electromagnetic clutch MC. Here, in the electromagnetic clutch MC, a pulley 11 is rotatably supported by the front housing 1 of the viscous heater VH via a bearing device 10, and an exciting coil 12 is provided in the pulley 11. The exciting coil 12 is connected to an air conditioner ECU that is not shown. A hub 14 is secured by a bolt 13 to the drive shaft 8 of the viscous heater VH, and is further secured to an armature 16 via a leaf spring 15. The pulley 11 is rotated by the engine of the vehicle that is not shown through a belt.

In the thus constituted viscous heater VH, when an electric current is supplied to the exciting coil 12 in the electromagnetic clutch MC in response to an instruction from the air conditioner ECU, the armature 16 magnetically adheres to the pulley 11 and, hence, the drive shaft 8 is driven by the engine. In the viscous heater VH, therefore, the rotor 9 rotates in the operation chamber, and the silicone oil SO generates heat due to the shearing in the fluid-tight gaps among the wall surfaces of the front and rear plates 2, 3 and the outer surfaces of the rotor 9. The thus generated heat is exchanged by the cooling water in the front and rear water jackets FW and RW, and the cooling water that is heated circulates through the circulating circuit.

In the viscous heater VH during this period, the torque of the drive shaft 8 is transmitted to the bush 9*b* of the rotor 9, and the torque of bush 9*b* of the rotor 9 is transmitted to the main rotor body 9*a*. Here, there is a small difference in the coefficient of thermal expansion β between the drive shaft 8 and the bush 9*b*, and a very little or almost no change occurs in the size between the drive shaft 8 and the bush 9*b*. Accordingly, despite the bush 9*b* being secured to the drive shaft 8 by relying only upon pressing-in in this viscous heater VH, the interference between the drive shaft 8 and the bush 9*b* changes very little from that during the assembly, and the torque of the drive shaft 8 is reliably transmitted to the bush 9*b*. Besides, the main rotor body 9*a* and the bush 9*b* are firmly tightened together when the cast is cooled due to a difference in the coefficient of thermal expansion β between the main rotor body 9*a* and the bush 9*b*. In particular, since the notches 9*c* are formed on the outer peripheral surface of the bush 9*b* as described above, the coupling strength to the main rotor body 9*a* is reliably and mechanically reinforced in the rotational direction and in the axial direction. Therefore, even when the interference decreases due to a difference in the thermal expansion in the radial direction between the main rotor body 9*a* and the bush 9*b* due to a rise in the temperature, the torque of the bush 9*b* is reliably transmitted to the main rotor body 9*a*. In the viscous heater VH as described above, slip hardly occurs between the drive shaft 8 and the rotor 9 during the operation, and the drive shaft 9 and the rotor 9 reliably rotate together. Therefore, the viscous heater VH makes it possible to reliably accomplish any desired heating in the compartment during the warming-up of the engine.

In this viscous heater VH, furthermore, the drive shaft 8 and the bush 9*b* are made of an iron-type metal to maintain a high rigidity, and the main rotor body 9*b* is made of an aluminum-type metal to realize easy machinability and a reduction in weight.

In this viscous heater VH, further, the notches 9*c* are formed on the outer peripheral surface of the bush 9*b*, and the mechanically coupled strength between the bush 9*b* and the main rotor body 9*a* can be reinforced by the notches 9*c* in the axial direction, too, preventing the main rotor body 9*a* from being displaced in the axial direction relative to the bush 9*b* and preventing the main rotor body 9*a* from interfering the front and back wall surfaces of the heat-generating chamber 6.

In this viscous heater VH, further, the bush 9*b* is inserted into the main rotor body 9*a* and is secured in the main rotor body 9*a*, without requiring members such as rivets that were used, suppressing an increase in the number of parts, except the bush 9*b*, and suppressing the cost of production.

In this viscous heater VH, further, the bush 9*b* is pressed in the drive shaft 8 so as to be secured to the drive shaft 8, decreasing the number of the steps and suppressing the cost of production.

In this viscous heater VH, further, the rotor 9 is secured by pressing-in the bush 9*b* onto the drive shaft 8 maintaining a predetermined interference at the time of assembling and, hence, constitutes a first sub-assembly together with the drive shaft 8. The front plate 2 holding the bearing device 7, too, is constituted as a second sub-assembly, and the first sub-assembly is pressed in the inner race 7*a* of the bearing device 7 of the second sub-assembly. In this case as shown in FIG. 4, the bush 9*b* pressed in the drive shaft 8 is positioned in contact with the inner race 7*a* of the bearing device 7, facilitating the assembling of the rotor 9. Further, the main rotor body 9*a* is made of a material softer than the bush 9*b*. However, since the surface 9*e* of the main rotor body 9*a* has a step Δ of several microns with respect to the reference surface 9*d* of the bush 9*b*, the main rotor body 9*a* receives no load from the inner race 7*a* of the bearing device 7 and is not deformed. In the viscous heater VH, the main rotor body 9*a* does not come into contact with the inner race 7*a* of the bearing device 7 or into contact therewith under the no-load condition owing to the gap Δ despite the internal temperature being raised by heat generated by the silicone oil SO during the operation, and the main rotor body 9*a* of a material having a coefficient of thermal expansion larger than that of the bush 9*b* undergoes a thermal expansion to a degree larger than that of the bush 9*b*. That is, the thermal expansion of the main rotor body 9*a* is permitted due to the gap between the main rotor body 9*a* and the inner race 7*a* of the bearing device 7. Therefore, the main rotor body 9*a* does not push the inner race 7*a* of the bearing device 7 in the axial direction and receives no reaction. Accordingly, the main rotor body 9*a* is not deviated in the axial direction relative to the bush 9*b* and is not deformed along the boundary thereof. Thus, the viscous heater VH provides both easy assembly and durability.

Consequently, the viscous heater VH of the embodiment 1 can be cheaply manufactured, permits the drive shaft 8 and the rotor 9 to be reliably rotated together during the operation and provides both easy assembly and durability.

Embodiment 2.

Figure 5:
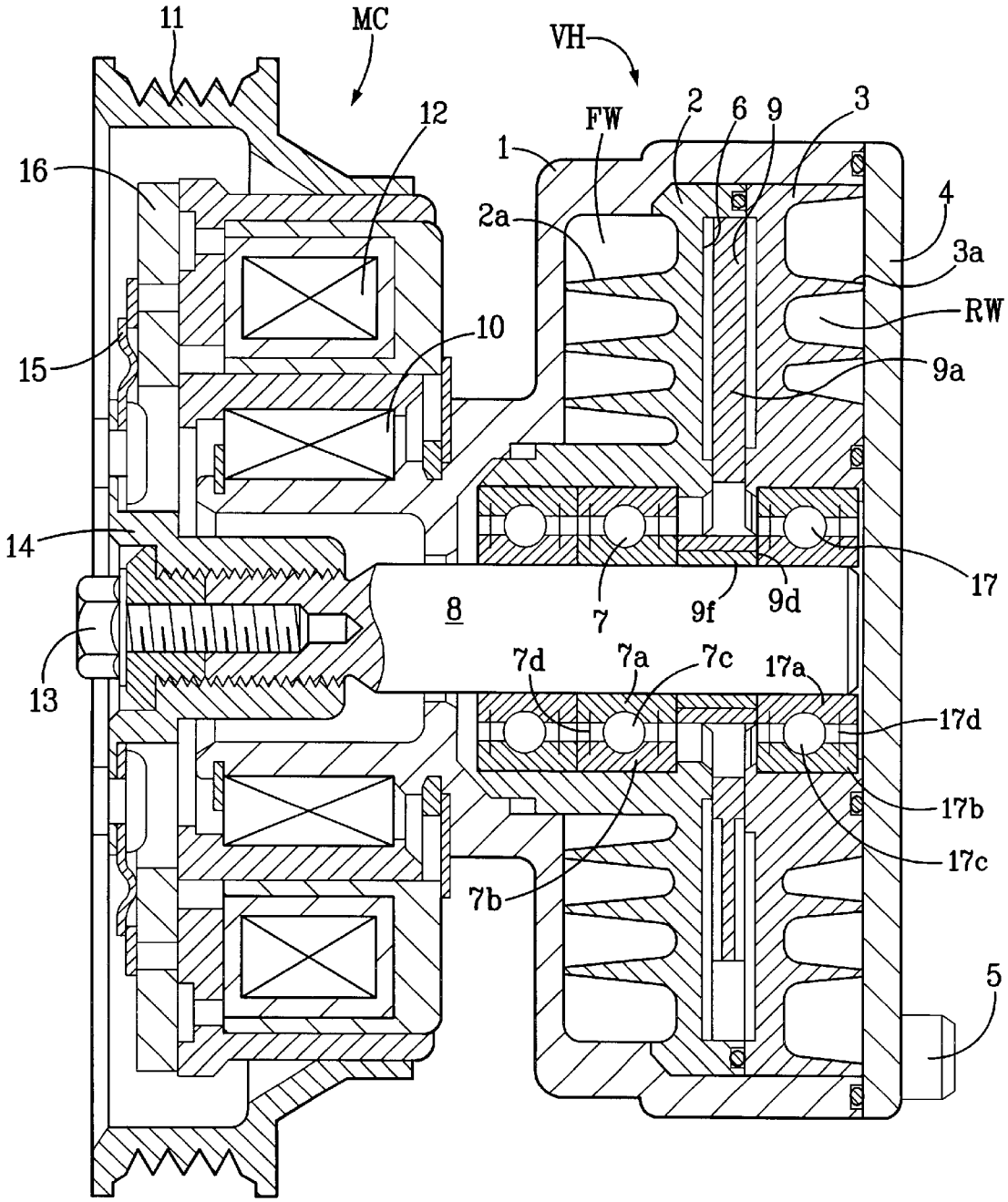
FIG. 5 is a sectional view of the viscous heater according to an embodiment 2 of the present invention.

In the viscous heater VH which is the heat generator of the embodiment 2 as shown in FIG. 5, the rear plate 3 and the rear housing body 4 do not form a reservoir chamber unlike that of the viscous heater VH of the embodiment 1, and the bearing device 17 of a single row is provided in the shaft hole of the rear plate 3. The bearing device 17 includes an inner race 17*a*, an outer race 17*b* and balls 17*c* held by a holding unit 17*d* between the inner race 17*a* and the outer race 17*b*. The inner race 17*a* is made of an iron-type metal (carbon steel for bearing) and has a coefficient of thermal expansion β of about $10.7\times10^{-6}$ (° C.). A sealing member that is not shown is provided on the front side between the inner race 17*a* and the outer race 17*b* of the bearing device 17.

The drive shaft 8 is rotatably supported by the bearing devices 7 and 17, and the rotor 9 is secured to the drive shaft 8 between the bearing devices 7 and 17. The rotor 9 has a bush 9*f*, that forms the inner side of a boss portion that protrudes back and forth in the axial direction, necessary for the main rotor body 9*a*.

Figure 6:
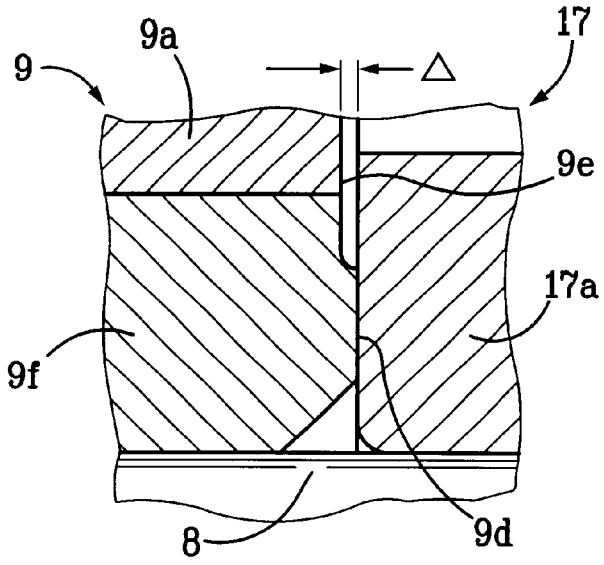
FIG. 6 is a sectional view illustrating, on an enlarged scale, the major portion of the viscous heater of the embodiment 2.

In machining the rotor 9 or the cast article as shown in FIG. 6, a reference surface 9*d* is also formed on the rear surface of the bush 9*f*, and a surface 9*e* having a step Δ of several microns is formed in the back surface of the bush 9*f* of a portion on the side of the main rotor body 9*a* and on the main rotor body 9*a*. Thus, the surface 9*e* of the back surface of the bush 9*f* of a portion on the side of the main rotor body 9*a* and of the main rotor body 9*a* maintains a gap Δ with respect to the inner race 17*a* of the bearing device 17. The constitution in other respects is the same as the viscous heater VH of the embodiment 1.

Thus, the viscous heater VH exhibits actions and effects same as those of the embodiment 1.

Embodiment 3.

Figure 7:
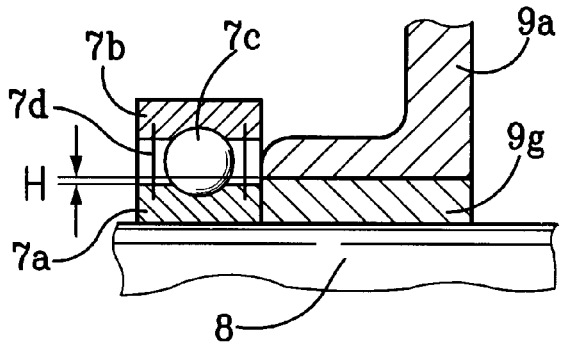
FIG. 7 is a sectional view illustrating a major portion of the viscous heater according to an embodiment 3 of the present invention.
Figure 8:
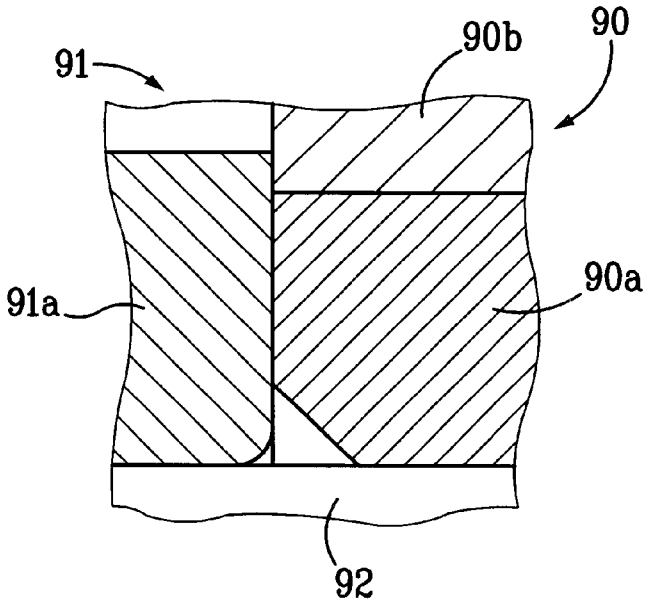
FIG. 8 Prior Art
FIG. 8 is a sectional view illustrating, on an enlarged scale, a major portion of a conventional heat generator.

In the viscous heater VH which is the heat generator according to an embodiment 3 as shown in FIG. 7, the outer diameter of the bush 9*g* is selected to be larger by a radius H than the inner race 7*a* of the bearing device 7 and the portion of the main rotor body 9*a* of the boss portion is positioned between the inner race 7*a* and the outer race 7*b* of the bearing device 7, so that the portion of the main rotor body 9*a* of the boss portion will not interfere with the holder unit 7*d* of the bearing device 7 or with the sealing member that is not shown. The constitution in other respects is the same as the viscous heater VH of the embodiment 1.

In this viscous heater VH, though the thickness of the portion of the main rotor body 9*a* of the boss portion is limited, by the communication hole 9*d*, to lie between the inner race 7*a* and the outer race 7*b* of the bearing device 7, the actions and effects exhibited are the same as those of the embodiment 1.

In the heat generator of the invention, when the drive shaft is driven so that the main rotor body of the rotor shears the viscous fluid to generate heat, the torque of the drive shaft is transmitted to the base portion of the rotor secured to the drive shaft, and the torque of the base portion of the rotor is transmitted to the main rotor body in which the base portion is inserted. Here, there is a small difference or almost no difference in the coefficient of thermal expansion between the drive shaft and the base portion, and a very little or almost no change occurs in size between the drive shaft and the base portion. Accordingly, although the base portion is secured to the drive shaft relying only upon pressing-in, the interference between the two changes very little or not at all from that of during the assembly, and the torque of the drive shaft is reliably transmitted to the base portion. Besides, the main rotor body and the base portion inserted into the main rotor body are firmly tightened together when they are cooled due to a difference in the coefficient of thermal expansion between the two. Accordingly, the torque of the base portion is reliably transmitted to the main rotor body.

In this heat generator, therefore, slipping hardly occurs between the drive shaft and the rotor during the operation, and the two reliably rotate together. Therefore, the heat generator makes it possible to reliably accomplish any desired heating in the compartment and during the warming-up of the engine.

In this heat generator, furthermore, the base portion is inserted into the main rotor body and is secured in the main rotor body, without requiring members such as rivets that were so far used, suppressing an increase in the number of parts except the base portion and suppressing the cost of production.

In this heat generator, further, the base portion is not necessarily secured to the drive shaft by a spline and is secured to the drive shaft relying only upon pressing-in, thereby decreasing the number of the steps and suppressing the cost of production.

In this viscous heater VH, further, the rotor is easily assembled if the base portion secured to the drive shaft is positioned while being contacted to the positioning member. In the heat generator, the main rotor member does not push the positioning member in the axial direction even though the internal temperature is raised by heat generated by the viscous fluid during the operation, and the main rotor body of a material having a coefficient of thermal expansion larger than that of the base portion undergoes a thermal expansion to a degree larger than that of the base portion, since the main rotor body is permitted to undergo the thermal expansion with respect to the positioning member. Therefore, the main rotor body receives no reaction, and is not deviated in the axial direction relative to the base portion or is not deformed along the boundary thereof. Thus, the heat generator provides both easy assembly and durability.

Consequently, the heat generator of the invention can be cheaply manufactured, permits the drive shaft and the rotor to be reliably rotated together during the operation and provides both easy assembly and durability.

The heat generator of the present invention may employ, as a positioning member, a stepped portion formed in the drive shaft for positioning, a circular clip fitted to the drive shaft for positioning, circular clips for securing the bearing device and the shaft-sealing device, a bearing device secured to the drive shaft without circular clip, and a shaft-sealing device secured to the drive shaft without circular clip. When the positioning member is a bearing device, the base portion is positioned upon coming in contact with the inner race of the bearing device, and the main rotor portion is permitted to undergo a thermal expansion relative to the inner race thereof.

As an embodiment in which the main rotor body in the heat generator of the invention is permitted to undergo a thermal expansion relative to the bearing device, the bearing manufacturer may produce such a bearing device that the inner race thereof maintains a gap permitting the main rotor body to undergo a thermal expansion. In order to suppress the cost of the bearing device, further, the rotor manufacturer may produce such a rotor that the base portion thereof has an outer diameter larger than the inner race of the bearing device and, when the main rotor body has a boss portion with the base portion being inserted therein, the portion of the main rotor body of the boss portion is positioned between the inner race and the outer race of the bearing device, so that the portion of the main rotor body of the boss portion will interfere with neither the holding unit nor the sealing member of the bearing device. Moreover, the manufacturer of the rotor may produce such a rotor that the main rotor body has a gap that permits the inner race to undergo a thermal expansion. When the inner race of the bearing device has a gap that permits the main rotor body to undergo the thermal expansion or when the main rotor body has a gap that permits the inner race to undergo the thermal expansion, the two do not come in contact with each other or come in contact with each other under a no-load condition despite the main rotor body being thermally expanded in the axial direction.

When the main rotor body has a gap that permits the inner race to undergo the thermal expansion, it is desired that the portion on the side of the main rotor body of the base portion, too, has a gap that permits the inner race to undergo the thermal expansion. Then, after the rotor including the main rotor body and the base portion inserted into the main rotor body is cast, a gap can be easily and reliably formed in the main rotor body by machining the cast article, and a reference surface can be easily formed on the remaining portion of the base portion for accomplishing the positioning upon coming in contact with the inner race of the bearing device.

The drive shaft is made of an iron-type metal, the base portion of the rotor is made of an iron-type metal, and the main rotor body of the rotor is made of an aluminum-type metal. Then, the drive shaft and the base portion made of the iron-type metal maintain a high rigidity, and the main rotor body made of the aluminum-type metal realizes easy machinability of the heat generator and a reduction in the weight.

While the invention has been described by reference to specific embodiments chosen for purposes of illustration, it should be apparent that numerous modifications could be made thereto by those skilled in the art without departing from the basic concept and scope of the invention.

What is claimed is:

1. A heat generator comprising:

a housing forming therein a heat-generating chamber and a heat-receiving chamber neighboring said heat-generating chamber and circulating a fluid;

a drive shaft rotatably supported by said housing via bearing devices;

a rotor rotatably provided in said heat-generating chamber by said drive shaft; and a viscous fluid filled in the gaps among wall surfaces of the heat-generating chamber and outer surfaces of the rotor and generates heat due to the shearing when said rotor is rotated; wherein said rotor includes a main rotor body for shearing said viscous fluid made of a material having a coefficient of thermal expansion larger than that of said drive shaft, and a base portion made of a material having a coefficient of thermal expansion equivalent to that of said drive shaft, inserted into said main rotor body and secured to said drive shaft while being positioned upon coming in contact with a positioning member, said rotor main body and said positioning member maintaining a gap which permits a thermal expansion of said rotor main body relative to said positioning member.

2. A heat generator according to claim 1, wherein the positioning member is a bearing device, the base portion is positioned upon coming in contact with an inner race of said bearing device, and the main rotor body is permitted to undergo a thermal expansion relative to said inner race.

3. A heat generator according to claim 2, wherein the gap is between the main rotor body and the inner race of the bearing device and permits a thermal expansion relative to the inner race of the bearing device.

4. A heat generator according to claim 3, wherein the gap extends to a portion of the base portion and permits a thermal expansion relative to the inner race of the bearing device.

5. A heat generator according to claim 1, wherein the drive shaft is made of an iron-type metal, the base portion of the rotor is made of the iron-type metal, and the main rotor body of the rotor is made of an aluminum-type metal.

* * * * *